United States Patent [19]

Geberth, Jr.

[11] Patent Number: 4,755,638

[45] Date of Patent: Jul. 5, 1988

[54] PRESSURE OPERATED SWITCH FOR CONTROLLING AN AIRLESS PAINT PUMP

[76] Inventor: John D. Geberth, Jr., 10 Goose Cove La., Ramsey, N.J. 07446

[21] Appl. No.: 52,269

[22] Filed: May 21, 1987

[51] Int. Cl.[4] ..... H01H 35/38

[52] U.S. Cl. ..... 200/82 R; 200/82 C; 200/83 J; 73/745

[58] Field of Search ..... 307/118; 340/611, 626; 73/717, 723, 745; 91/1; 92/5 R, 101, 102; 200/83 J, 83 S, 83 SA, 82 R, 82 C, 153 T, 83 Y

[56] References Cited

U.S. PATENT DOCUMENTS

| | | | |
|---|---|---|---|
| 2,808,484 | 10/1957 | Beck | 200/83 Y |
| 3,516,279 | 6/1970 | Maziarka | 200/82 C |
| 3,848,517 | 11/1974 | Hawke | 200/83 J |
| 4,184,809 | 1/1980 | Kelley | 417/387 |
| 4,317,971 | 3/1982 | Roth | 200/82 C |
| 4,438,305 | 3/1984 | Johnson | 200/82 C |

FOREIGN PATENT DOCUMENTS

| | | | |
|---|---|---|---|
| 1494122 | 9/1967 | France | 73/745 |

*Primary Examiner*—G. P. Tolin

*Attorney, Agent, or Firm*—Collard, Roe & Galgano

[57] ABSTRACT

There is provided a hydraulic pressure operated electrical switch having a spring biased piston which is movable by the force of the hydraulic pressure of the fluid to be sensed to activate a microswitch. The pressure required to move the piston can be altered by adjusting the force produced by the spring acting on the piston. An operating pressure differential is provided by a diaphragm which operates to move the piston by reason of the hydraulic pressure exerted thereon. The diaphragm has a spring rate and produces a force in conjunction with the spring bias against the piston when the piston is moved as a result of the hydraulic pressure overcoming the spring bias. The spring rate of the diaphragm is affected by the amount of hydraulic pressure exerted thereon so that, as a result of adjusting the operating pressure of the switch, the operating differential pressure is altered.

10 Claims, 3 Drawing Sheets

PRESSURE OPERATED SWITCH FOR CONTROLLING AN AIRLESS PAINT PUMP

The present invention relates generally to a hydraulic pressure operated switch which senses the pressure of a fluid and transmits an electrical signal based thereon. More particularly, the present invention relates to a hydraulic pressure operated switch or controller for electrically controlling the operation of a device based on the sensed hydraulic pressure wherein the operating or activating pressure thereof is adjustable and wherein a varying differential pressure, based on the operating pressure, activates and deactivates the controlling electrical signal produced by the switch.

Hydraulic pressure operated switches are utilized for controlling the operation of devices such as hydraulic pumps which increase the pressure of fluid for particular purposes. One such purpose is in the painting industry where pressurized fluid paint is issued from a spray gun and, because of the high pressure of the fluid paint, the paint issues from the spray gun in the form of a spray suitable for painting. One such pump system operates with an electric motor, the operation of which is controlled by an adjustable pressure operated switch which signals the motor to run when the fluid pressure is low and signals the motor to stop when the fluid pressure has reached a predetermined high or operating level. The start and stop cycling of such motors, in other words the pressure differential of the switch, must be chosen such that the cycling frequency is not too great so as to result in burn-out of the motor. Thus, the differential is established at the highest operating pressure such that the cycling frequency is within acceptable limits for the motor. However, this differential does not vary as the pressure switch or controller is adjusted for lower operating pressures. As a result, the lower operating pressures are relatively high so that the lowest pressure at the fixed differential still produces an acceptable painted finish. Therefore, the versatility of this pump system is severely limited because of the relatively narrow adjustment range available.

A type of DC motor operated pump system also available is one wherein the motor runs constantly but at variable speeds depending on the pressure requirements. Thus, when a high pressure setting is chosen, the motor runs at a constant high torque to deliver the fluid at the indicated pressure. When a low pressure setting is chosen, again the motor runs at a constant lower torque to deliver the fluid at the indicated pressure. The speed of the motor changes accordingly depending upon the size of the nozzle opening, the speed being higher for the larger opening and lower for the smaller opening. Such a system is very expensive and the complexity of the control system results in reduced reliability.

It is, therefore, an object of the present invention to provide an adjustable hydraulic pressure operated switch for controlling the start and stop operation of a device such as a hydraulic pump wherein the differential pressure between the start and stop modes varies as a function of the adjusted operating pressure of the switch so that the differential increases as the operating pressure is increased and decreases as the operating pressure is decreased.

The above object, as well as others which will hereinafter become apparent, is accomplished in accordance with the present invention by the provision of a hydraulic pressure operated switch wherein the pressure of the fluid is exerted upon a movable piston, the movement of which activates a normally closed microswitch to start and stop the motor driving the hydraulic pump which pressurizes the fluid. The movable piston is spring biased against the hydraulic pressure exerted thereon by means of a spring whose spring rate is adjustable so that the hydraulic pressure necessary to move the piston to operate the microswitch is variable. The differential of pressure between the hydraulic pressure necessary to commence movement of the piston against the force of the spring bias and that necessary to move the piston sufficiently to operate the microswitch is determined by the "spring rate" of a diaphragm disposed between the movable piston and the pressurized fluid. Thus, when the fluid pressure acting on the piston is sufficient to overcome the spring force of the biasing spring, the piston is lifted off its seat, however, as this occurs, the diaphragm begins to stretch in a circumferential or circular segment at the juncture of the piston and the piston cylinder producing a returning or biasing force thereby which can only be overcome by increased hydraulic pressure. The maximum resulting hydraulic pressure is that which causes the diaphragm to stretch at this circumferential segment sufficiently to result in enough piston movement to overcome the differential distance of the microswitch and cause it to operate. The operating pressure of the pressure switch can be adjusted by merely adjusting the force of the spring which biases the piston. The differential switching pressure is simultaneously altered because the spring rate of the diaphragm is changed by the increase or decrease in the operating pressure. Thus, as the operating pressure of the switch is increased so that an increased hydraulic pressure is required to operate the switch, the spring rate of the diaphragm increases so that the differential likewise increases. As the operating pressure of the switch is lowered, the diaphragm spring rate likewise is lowered so that a smaller differential pressure results.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
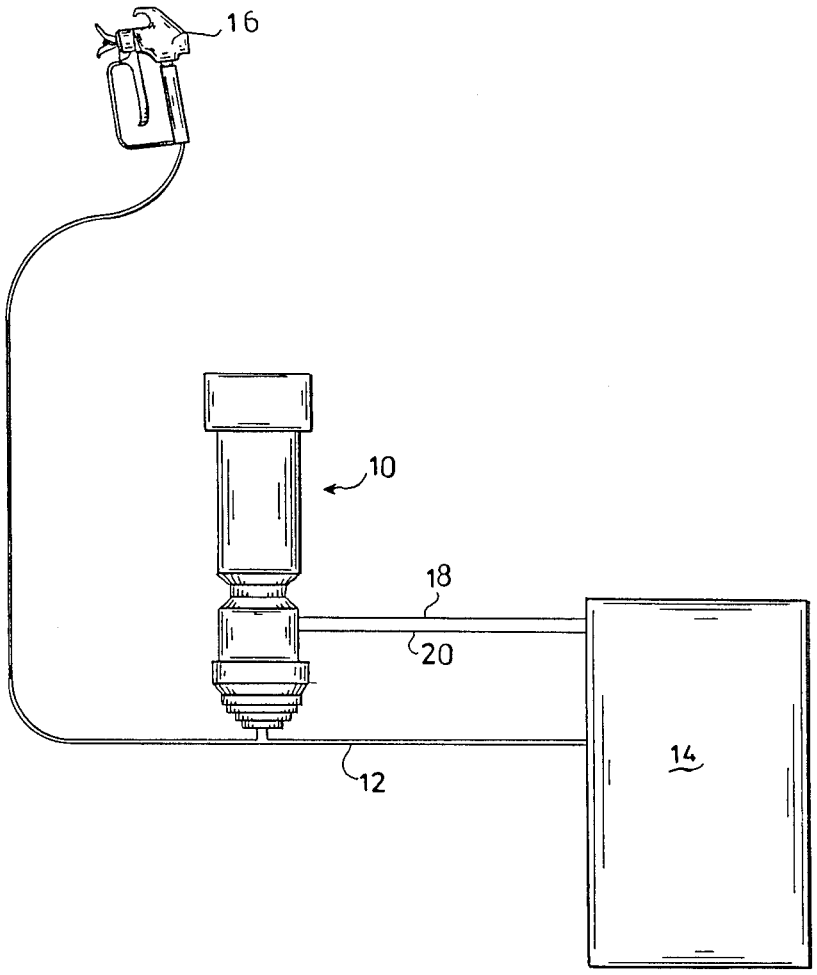
FIG. 1 is a schematic representation of a high pressure paint spray system incorporating the fluid pressure switch of the present invention.

Now turning to the drawings, there is shown in FIG. 1 a hydraulic pressure operated switch, designated 10, which is arranged in fluid line 12 for the purpose of sensing the fluid pressure therein. Fluid line 12 supplies pressurized fluid from hydraulic pump 14 to a pressurized fluid distributor which, in this case, is a hydraulically operated spray gun, designated 16. Hydraulic pressure switch 10 is adapted to electrically control, via electrical wires 18 and 20, the operation of hydraulic pump 14. It is to be appreciated that switch 10 can be used to control the operation of other devices, such as valves, clutches, etc.

If liquid paint is to be atomized and sprayed by spray gun 16, it must be supplied to spray gun 16 through fluid line 12 at a pressure sufficient to cause atomization when exiting from the spray nozzle of spray gun 16. For instance, hydraulic pump 14 could be switched on for pressurizing the fluid at a low pressure of 1500 psi and turned off at the higher pressure of 2000 psi, thus resulting in a differential of 500 psi. This differential between 1500 and 2000 psi would be sufficient to result in atomization of the fluid at all pressures therebetween. Thus, when the fluid pressure has reached 2000 psi, hydraulic pump 14 would be turned off and, as spray gun 16 is operated, reducing the fluid pressure to 1500 psi, hydraulic pump 14 would be turned on to increase the fluid pressure to the upper limit. It is the purpose of hydraulic pressure switch 10 to activate the start and stop cycles of hydraulic pump 14.

Hydraulic pressure switch 10 is also adjustable so as to regulate the pressure of the fluid delivered by hydraulic pump 14 to spray gun 16. Thus, if the operator wishes to adjust the operating pressure of the system from 2000 psi to 900 psi, pressure switch 10 can be adjusted so that the highest pressure delivered by hydraulic pump 14 to fluid line 12 is 900 psi, at which point the pump is turned off. The differential pressure at which the pump is again turned on so as to increase the fluid pressure in fluid line 12, in such a case, should not be the 500 psi differential of the higher operating pressure since, at a pressure of 400 psi, the fluid exiting from the nozzle of spray gun 16 may not atomize. Thus, as will be explained hereinafter, the differential pressure is simultaneously changed automatically within pressure switch 10 so that a smaller differential is provided at the lower pressures.

Figure 2:
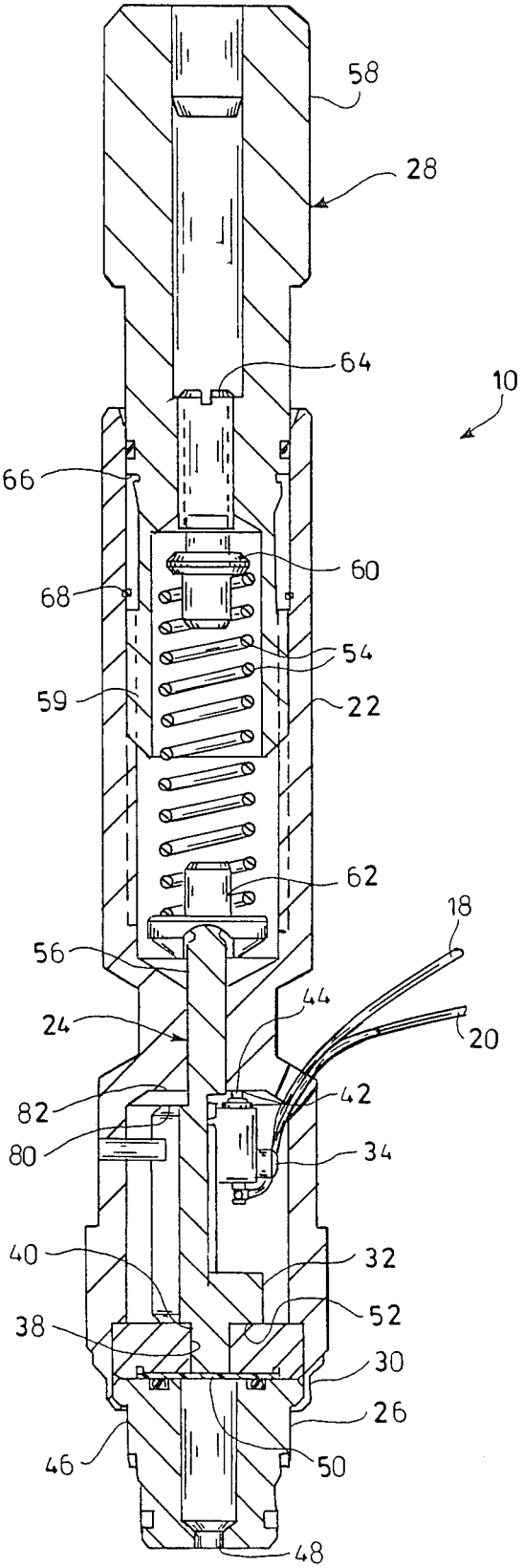
FIG. 2 is an enlarged cross-sectional view of the fluid pressure switch of the present invention.

As clearly seen in FIG. 2, hydraulic pressure switch 10 comprises a housing, designated 22, a transducer assembly, designated 24, a switch cap, designated 26, and a pressure adjustment assembly, designated 28. Housing 22 houses transducer assembly 24 and adjustment assembly 28 and is firmly attached to switch cap assembly 26 by formed metal retainer 30. Transducer assembly 24 includes axially movable piston 32, microswitch 34 and bushing 36. Bushing 36 is provided with a central bore 38 which guides head 40 of piston 32 for axial movement therein. Microswitch 34 is secured to piston 32 and includes an activating push button 42 which is adapted to cooperate with stop 44 of housing 22 to activate microswitch 34 in response to the axial movement of piston 32. Electrical control wires 18 and 20, which control the on and off cycles of hydraulic pump 14, are operatively connected to microswitch 34. The type of microswitch utilized herein is a normally closed switch having a 0.002 inch differential movement. Thus, 0.002 inch movement of push button 42 downwardly is required to open the switch and 0.002 inch movement upwardly therefrom is required to close the switch.

Switch cap assembly 26 includes a switch cap 46 having a bore 48 therethrough which is aligned with bore 38 of bushing 36 and head 40 of piston 32. Fixedly disposed between switch cap 46 and bushing 36 and covering the crown of piston head 40 is a diaphragm, designated 50, which seals the operating mechanism of pressure switch 10 from the fluid whose pressure is to be sensed in bore 48. Diaphragm 50 also permits the differential pressure of the switch to vary as a function of the adjustable operating pressure thereof.

Piston 32 is maintained in its normal position defined by the seating of shoulder 52 of the piston on face 53 of bushing 36 by the bias of compression spring 54 which acts axially against rod 56 of piston 32. The adjustment of the spring force of spring 54 by compressing or releasing the length thereof changes the necessary force to lift piston 32 off its seat so as to move push button 42 and activate microswitch 34. This change in spring force changes or alters the hydraulic pressure necessary to operate switch 10. Adjustment of the force produced by spring 54 is accomplished by means of adjustment assembly 28 which includes an adjustment knob 58 threadably engaged at 59 with housing 22, a spring retainer 60 engaging the upper end of spring 54, and a spring retainer 62 engaging the lower end of spring 54. Spring retainer 60 is operatively engaged with adjustment knob 58 and spring retainer 62 is engaged with rod 56 of piston 32. Thus, as adjustment knob 58 is screwed into housing 22, the spring rate or force exerted by spring 54 against piston 32 increases and, as adjustment knob 58 is screwed out of housing 22, the force decreases.

Maximum setting for the switch can be provided by means of set screw 64 which is threadably engaged with adjustment knob 58 and which engages upper spring retainer 60. Thus, with adjustment knob 58 fully screwed into housing 22 so that shoulder 66 of adjustment knob 58 contacts stop 68 within housing 22, said screw 64 can then be screwed in or out of adjustment knob 58 to thereby adjust the spring tension of spring 54 so as to set the upper operating pressure of switch 10.

Figure 3:
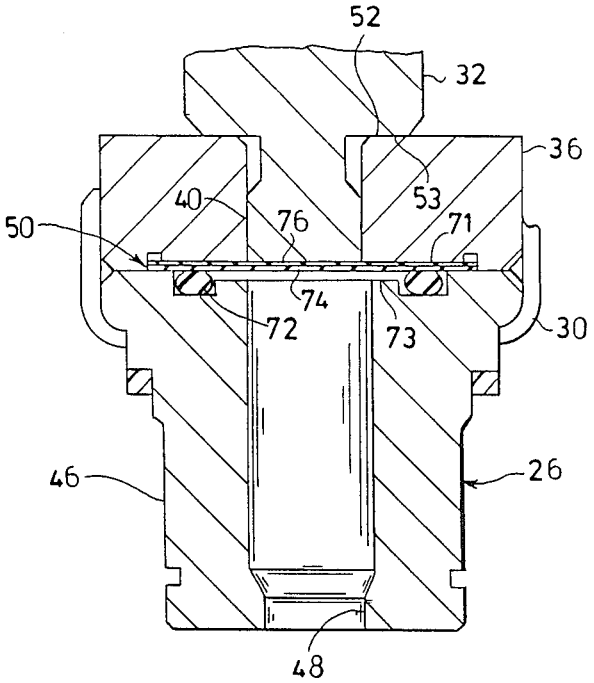
FIG. 3 is an enlarged detail view of the fluid pressure switch of FIG. 2 showing the diaphragm and operating piston.

Now turning to FIG. 3, a detail of pressure switch 10 is shown wherein it can be seen that diaphragm 50 is pinioned at its outer circumferential rim 70 between the mating surfaces of bushing 36 and switch cap 46. Switch cap assembly 26 includes an O-ring seal, designated 72, which engages diaphragm 50 radially inwardly from rim 70 to seal against the pressurized fluid in bore 48 and prevent it from passing between the engaging surfaces of bushing 36 and switch cap 46. An annular segment of diaphragm 50, designated 71, between pinioned circumferential rim 70 and bore 38 of bushing 36 remains unrestrained by reason of the annular undercut 73 in the face of switch cap 46.

Diaphragm 50 must be such as to stretch sufficiently in conjunction with the movement of piston 32 against which it abuts to activate microswitch 34 without exceeding the elastic limit or result in tearing of the material of the diaphragm. Any suitable material may be used for diaphragm 50 as long as the spring rate of the material when stretched is satisfactory (as discussed below). Preferably, diaphragm 50 is comprised of two layers superimposed one on the other, a first layer, designated 74, consists of a layer of relatively soft polyethylene whereas the second layer, designated 76, adjacent the crown of piston head 40 consists of a thin layer of stiff material such as nylon. Nylon layer 76, because of its stiffness, cannot be extruded between piston head 40 and bore 38 as a result of the high pressure of the fluid in bore 48. If a softer material were utilized for layer 76, such as polyethylene, the material would be extruded between the piston and bore 38 and cause the piston to jam. Also, polyethylene layer 74 helps to evenly distribute the hydraulic pressure over layer 76.

Figure 4:
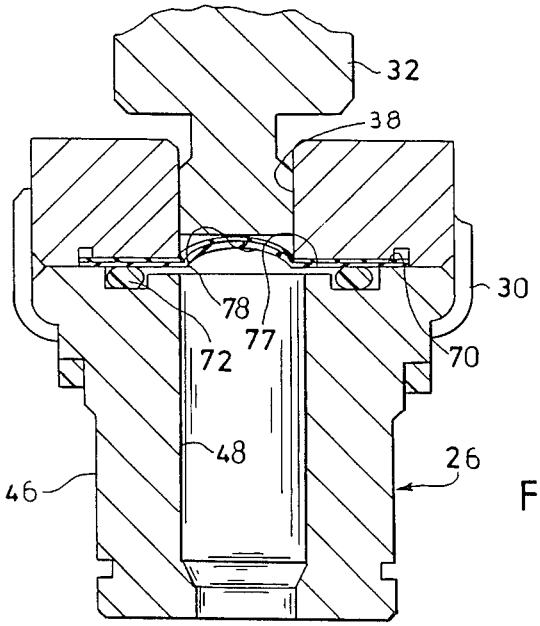
FIG. 4 is a detail view similar to that of FIG. 3 showing the operating movement of the piston.

As clearly seen in FIG. 4, as axially movable piston 32 moves upwardly against the force of spring 54 due to the high pressure of the fluid in bore 48, diaphragm 50 is caused to stretch radially in a circular segment between a point 77, radially inwardly from its pinioned rim 70, and a point 78 radially inwardly from bore 38 of bushing 36. The length of the distance between points 77 and 78 determines the spring rate of diaphragm 50. This spring rate results in a spring force which acts against the fluid pressure in bore 48 and the more diaphragm 50 is stretched, the greater is the spring force produced. The amount of this spring force produced when piston 32 moves sufficiently to overcome the differential movement of microswitch 34 determines the pressure differential of switch 10. Thus, as the pressure of the fluid in bore 48 increases so as to overcome the force of spring 54, thereby commencing the movement of piston 32 off its seat, the return force, due to stretching of diaphragm 50, also commences and increases the farther piston 32 moves from its seat. Thus, the differential pressure is determined by the amount of force, over and above that required to overcome spring 54, which equals the force developed by the stretching of diaphragm 50 between points 77 and 78 due to the distance moved of piston 32 whereat push button 42 of microswitch 34 is activated. Points 77 and 78 defining the circular segment in which stretching or extension of diaphragm 50 occurs is dependent upon the amount of hydraulic pressure exerted on diaphragm 50 by the fluid in bore 48. Thus, the greater the amount of hydraulic pressure exerted on diaphragm 50 by the fluid, the farther outward from the center of diaphram 50 will be the point 78 and the farther inward from rim 70 will be point 77. Therefore, since the stretchable segment of diaphragm 50 is smaller, the resulting spring rate is greater. As a result, the pressure differential between the start and stop operation of hydraulic pump 14 will be small at the lower operating pressure setting of pressure switch 10 and will be large at the higher operating pressure of pressure switch 10. The chosen spring rate of the material of diaphragm 50 determines the differential pressure ranges.

In order to prevent excessive movement of piston 32, which could result in damage to microswitch 34 and the possible rupturing of the material of diaphragm 50, cooperating shoulders 80 and 82 on piston 32 and housing 22, respectively, are provided. Thus, the total movement which piston 32 is capable of is limited between face 53 of bushing 36 and shoulder 82 of housing 22. This distance is greater than the differential movement of microswitch 34 so that activation thereof is not interfered with.

In operation, the operator sets the operating pressure at which hydraulic pump 14 is to operate under the particular circumstances by adjusting adjustment knob 58 of pressure switch 10 to the proper setting. Whatever pressure setting switch 10 is set at will automatically determine the differential of pressure at which switch 10 will control the operation of hydraulic pump 14. Thus, hydraulic pump 14 functions and pressurizes the fluid in fluid line 12 which communicates with bore 48 of switch cap assembly 26 of switch 10. The hydraulic pressure in bore 48 is sensed by diaphragm 50 therein which, in turn, transmits this pressure to the crown of piston head 40 of piston 32. When the hydraulic pressure of the fluid in bore 48 against piston 32 exceeds the force produced by spring 54 against piston 32, piston 32 will commence to move off its seat. In doing so, diaphragm 50 begins to stretch between some point radially inwardly of its pinioned outer rim 70 and point 78 thereon. The amount of hydraulic pressure exerted by the fluid in bore 48 determines the extent of the circular or annular segment of diaphragm 50 which will stretch. The amount of stretch of this circular segment of diaphragm 50, which results from the axial movement of piston 32 sufficient to activate push button 42 of microswitch 34, is translated into a force which determines the pressure differential for the switch operation at that pressure setting. Therefore, when the hydraulic pressure is at the low end of the differential, piston 32 will have moved sufficiently to overcome the differential movement of microswitch 34 and signal the start mode of hydraulic pump 14. When the hydraulic pressure of the fluid has reached the upper end of the differential, piston 32 will have moved the distance sufficient to overcome the differential movement of microswitch 34 and thus open the switch and signal the stop mode of pump 14.

While only a single embodiment of the present invention has been shown and described, it will be obvious that many changes and modifications may be made thereunto without departing from the spirit and scope of the present invention.

What is claimed is:

1. In a hydraulically operated painting system having a pressure pump for increasing the pressure of fluid paint sufficient for airless spray painting, an electric motor for driving the pressure pump, a spray gun or the like for atomizing the pressurized paint, and a pressure operated switch for controlling the operation of said electric motor, the improvement being said pressure operated switch comprising:

(a) a housing (b) a piston movable in said housing and having a piston crown which is operatively influenced by the hydraulic pressure exerted by the fluid paint;

(c) a single biasing element biasing said piston against the hydraulic pressure exerted thereon by the pressurized fluid paint;

(d) first adjustment means in said housing for adjusting the biasing force of said biasing element to a predetermined force so that a predetermined hydraulic pressure is required to overcome the biasing force;

(e) second adjustment means in said housing for adjusting the biasing force of said biasing element relative to the first adjustment means so as to establish an upper limit of the predetermined force;

(f) electric switch means in said housing and having a differential movement for switching, said means being associated with said movable piston which is adapted to move through a distance at least equal to the differential movement of said switch means; and (g) means in said housing for causing a variable differential switching response in said pressure operated switch in dependence on the varied predetermined hydraulic pressure, the differential switching response being determined by the difference between the hydraulic pressure necessary to cause movement of said piston through a distance at least equal to the differential movement of said switch means and the varied predetermined hydraulic pressure, the differential switching response varying so as to increase as the predetermined hydraulic pressure increases and decrease as the predetermined hydraulic pressure decreases, said variable differential switch response means including spring means producing a spring force contra to the force of said hydraulic pressure, in addition to said biasing element the spring rate of said spring means varying as a function of the varied predetermined hydraulic pressure.

2. The hydraulically operated painting system as defined in claim 1, wherein said biasing element comprises a compression spring aligned to oppose the movement of said piston caused by the influence of the hydraulic pressure thereon, and said first adjustment means comprises means for selectively compressing said compression spring so as to change the spring force exerted on said piston.

3. The hydraulically operated painting system as defined in claim 1, wherein said spring means comprises an elastic diaphragm disposed between the crown of said movable piston and the pressurized fluid paint, said diaphragm operatively communicating with the crown of said piston to move said piston in response to the hydraulic pressure of the fluid paint.

4. The hydraulically operated painting system as defined in claim 3, wherein the spring rate of said diaphragm due to the elasticity thereof is a function of the predetermined hydraulic pressure of the fluid paint wherein the lower the predetermined hydraulic pressure the radially larger is the circular segment of the diaphragm which is able to stretch and wherein the higher the predetermined hydraulic pressure the radially smaller is the circular segment of the diaphragm which is able to stretch.

5. The hydraulically operated painting system as defined in claim 3, wherein said diaphragm is formed of a layer of stiff plastic material.

6. The hydraulically operated painting system as defined in claim 5, wherein said diaphragm is formed of a layer of nylon.

7. The hydraulically operated painting system as defined in claim 6, wherein said diaphragm further comprises a second layer of a softer material disposed on the fluid side of said nylon layer.

8. The hydraulically operated painting system as defined in claim 7, wherein said softer layer is formed of polyethylene.

9. The hydraulically operated painting system as defined in claim 3, which further includes stop means cooperating with said piston to limit the movement thereof to a distance greater than the differential movement of said switch means but less than the distance that would result in rupture of said diaphragm.

10. The hydraulically operated painting system as defined in claim 2, wherein said housing houses said piston, said compression spring, said electric switch means and said means for causing a variable differential switching response, and wherein said first adjustment means includes an adjustment knob threadably engaged with said housing which operatively engages with said compression spring to alter the length thereof by the threadable adjustment of said knob with respect to said housing.

* * * * *